US009524676B2

(12) United States Patent
Bi et al.

(10) Patent No.: US 9,524,676 B2
(45) Date of Patent: Dec. 20, 2016

(54) ORGANIC LIGHT-EMITTING DIODE DISPLAY WITH BURN-IN REDUCTION CAPABILITIES

(71) Applicant: Apple Inc., Cupertino, CA (US)

(72) Inventors: Yafei Bi, Palo Alto, CA (US); Wei H. Yao, Palo Alto, CA (US); Ahmad Al-Dahle, San Jose, CA (US); Jean-Pierre S. Guillou, San Francisco, CA (US); Hyunwoo Nho, Palo Alto, CA (US); Koorosh Aflatooni, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 46 days.

(21) Appl. No.: 14/263,937

(22) Filed: Apr. 28, 2014

(65) Prior Publication Data

US 2014/0375704 A1 Dec. 25, 2014

Related U.S. Application Data

(60) Provisional application No. 61/838,745, filed on Jun. 24, 2013.

(51) Int. Cl.
*G09G 3/32* (2016.01)

(52) U.S. Cl.
CPC ..... *G09G 3/3275* (2013.01); *G09G 3/3233* (2013.01); *G09G 2320/041* (2013.01); *G09G 2320/046* (2013.01); *G09G 2320/0626* (2013.01); *G09G 2320/0633* (2013.01); *G09G 2320/0673* (2013.01); *G09G 2320/103* (2013.01); *G09G 2330/021* (2013.01);
(Continued)

(58) Field of Classification Search
None
See application file for complete search history.

(56) References Cited

U.S. PATENT DOCUMENTS 6,313,878 B1 * 11/2001 Jankowiak ..... G09G 5/003 315/368.17
8,217,867 B2 7/2012 Hamer et al.
(Continued)

FOREIGN PATENT DOCUMENTS

TW 200525472 8/2005

*Primary Examiner* — William Boddie
*Assistant Examiner* — Bryan Earles
(74) *Attorney, Agent, or Firm* — Treyz Law Group, P.C.; G. Victor Treyz; Joseph F. Guihan

(57) ABSTRACT

A display may receive image data to be displayed for a user of an electronic device. Display driver circuitry in the display may analyze the data to detect static data. The image data may contain static frames of data or static portions of a frame of data. In response to detection of static data, the display driver circuitry can take actions to avoid display damage due to burn-in effects. The display driver circuitry may reduce a peak luminance value associated with a peak luminance control algorithm, may reduce display brightness, may map image data to reduced brightness levels, or may take other actions to ensure that display pixels in the display are not damaged. Temperature information may be used in determining how to classify information as static data and in determining how significantly to reduce display pixel drive currents in response to the detection of static image data.

10 Claims, 17 Drawing Sheets

(52) U.S. Cl.
CPC . *G09G 2330/025* (2013.01); *G09G 2330/028* (2013.01); *G09G 2330/045* (2013.01)

(56) References Cited

U.S. PATENT DOCUMENTS

| | | | | |
|---|---|---|---|---|
| 8,977,945 | B2 * | 3/2015 | Li | H04N 21/43637 714/758 |
| 2005/0179399 | A1 | 8/2005 | Leo et al. | |
| 2006/0007204 | A1 | 1/2006 | Reddy et al. | |
| 2006/0007205 | A1 | 1/2006 | Reddy et al. | |
| 2006/0007249 | A1 | 1/2006 | Reddy et al. | |
| 2007/0127569 | A1 * | 6/2007 | Hatalkar | G06F 3/14 375/240.12 |
| 2008/0002070 | A1 | 1/2008 | Cok | |
| 2008/0284702 | A1 | 11/2008 | Shidara et al. | |
| 2009/0219295 | A1 | 9/2009 | Reijnaerts | |
| 2010/0053039 | A1 | 3/2010 | Park et al. | |
| 2010/0123651 | A1 | 5/2010 | Miller et al. | |
| 2011/0050751 | A1 * | 3/2011 | Park | G09G 3/3208 345/690 |
| 2011/0078536 | A1 * | 3/2011 | Han | G06F 3/1462 714/758 |
| 2011/0102446 | A1 | 5/2011 | Oterhals et al. | |
| 2012/0188262 | A1 * | 7/2012 | Rabii | G09G 5/393 345/534 |
| 2013/0235014 | A1 * | 9/2013 | Lee | G06F 1/32 345/211 |

* cited by examiner

ORGANIC LIGHT-EMITTING DIODE DISPLAY WITH BURN-IN REDUCTION CAPABILITIES

This application claims the benefit of provisional patent application No. 61/838,745, filed Jun. 24, 2013, which is hereby incorporated by reference herein in its entirety.

BACKGROUND

This relates generally to electronic devices, and more particularly, to electronic devices with displays.

Electronic devices often include displays. For example, cellular telephones and portable computers often include organic light-emitting diode displays for presenting visual information to a user.

To ensure that organic light-emitting diode displays do not consume too much power, electronic devices often use a peak luminance control algorithm (sometimes referred to as automatic current limiting). When this functionality is enabled, the peak luminance of displayed images is limited whenever the content being displayed exhibits large values of average luminance. When the average luminance of a frame of image data is low, the display is allowed to display content with a large peak luminance. In this situation, a display with sparse content such as a few icons on a black background can display the content brightly.

When the average luminance of a frame of image data is high, there is a potential for excessive current draw by the display if all of the content in the frame is displayed at maximum luminance. When the peak luminance control algorithm is used, the peak luminance of the content is reduced automatically by the display. This ensures that the amount of current and therefore the amount of power that is drawn by the display will be capped. In addition to limiting power consumption, this may help limit temperature rise in the display and thereby help extend the lifetime of display pixels in the display.

Manually and automatically controlled display brightness settings also are used to adjust how brightly organic light-emitting diode displays operate.

Organic light-emitting diode displays produce light by applying current to emissive organic materials. The performance of the emissive organic material in the display pixels of an organic light-emitting diode display can be adversely affected by operation at high currents and temperatures. As a result, organic light-emitting diode displays can be susceptible to burn-in effects in which static content creates undesirable visible artifacts on a display. For example, if a bright menu button is displayed for too long in a fixed location on a display, a faint outline of the menu button may remain visible even when a different image is being displayed on the display.

Although peak luminance control algorithms and global display brightness adjustments can limit excessive display currents, there is still a potential for burn-in effects when bright static content is displayed for too long on a display, particularly at elevated operating temperatures.

It would therefore be desirable to be able to reduce burn-in effects due to displaying static image content.

SUMMARY

An electronic device may include a display such as an organic light-emitting diode display. The display may have an array of organic light-emitting diode display pixels. There is a potential for display burn-in when bright images are displayed on the display for extended periods of time.

To avoid burn-in effects, display driver circuitry in the display may monitor for the present of static image content in some or all of a frame of data. When static image data is detected, the display driver circuitry can alter the way in which image data is being displayed on the display. For example, display brightness may be decreased, a peak luminance value associated with a peak luminance control algorithm may be reduced, and display pixel data values may be mapped to reduced brightness levels.

Temperature information may be used in determining how to classify information as static data and in determining how significantly to adjust the display in response to the detection of static image data.

Display driver circuitry may be provided that receives a display brightness setting associated with manual user input or an ambient light sensor reading. The display driver circuitry may also be provided with a peak luminance control algorithm scaling factor. A peak luminance control algorithm may process image data that is to be displayed on an array of display pixels in a display. The peak luminance control algorithm may compute the average luminance of the image data and may use the average luminance to determine an appropriate value for the peak luminance control algorithm scaling factor.

Circuitry in the display driver circuitry may be used to produce a first voltage based on the display brightness setting and may be used to produce a second voltage based on the first voltage and the peak luminance control algorithm scaling factor.

The display brightness setting and the peak luminance control algorithm may be provided to gamma curve selection circuitry that produces corresponding output signals. The output signals may be used to select one of a plurality of gamma curve look-up tables each of which corresponds to a respective gamma curve shape. The selected gamma curve look-up table may produce control signals that are applied to a gradient adjustment block. The gradient adjustment block may also be provided with the second voltage.

A plurality of corresponding voltages that are associated with the gamma curve shape of the selected gamma curve look-up table may be provided to a plurality of respective lines by the gradient adjustment block. The voltages from the plurality of lines may be supplied to digital-to-analog converter circuitry and may be used in supplying the array of display pixels with data signals so that images may be displayed on the array of display pixels using the gamma curve shape associated with the selected gamma curve look-up table.

Further features of the invention, its nature and various advantages will be more apparent from the accompanying drawings and the following detailed description of the preferred embodiments.

DETAILED DESCRIPTION

Electronic devices may include displays. The displays may be used to display images to a user. Illustrative electronic devices that may be provided with displays are shown in FIGS. 1, 2, 3, and 4.

Figure 1:
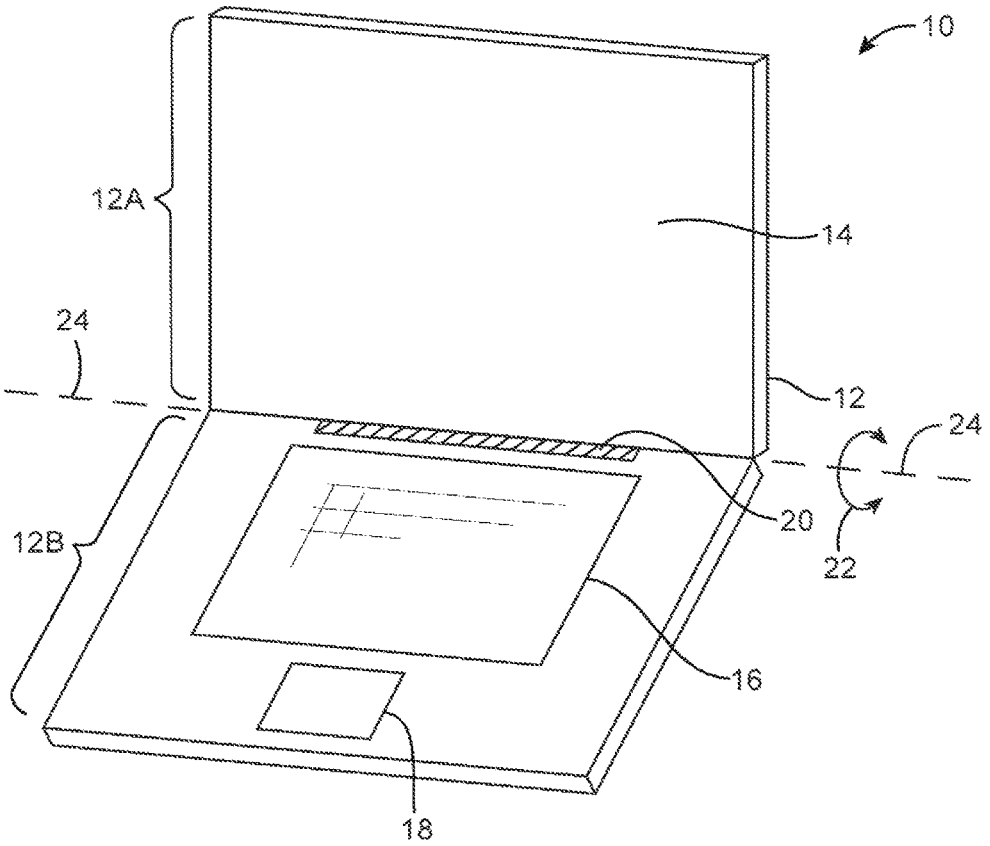
FIG. 1 is a perspective view of an illustrative electronic device such as a laptop computer with a display in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
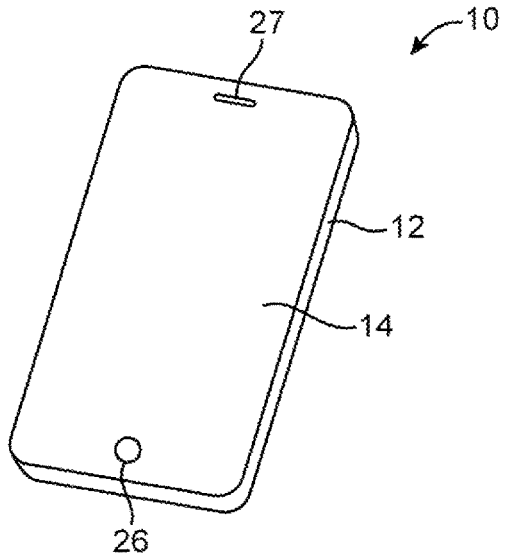
FIG. 2 is a perspective view of an illustrative electronic device such as a handheld electronic device with a display in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 27 of FIG. 2).

Figure 3:
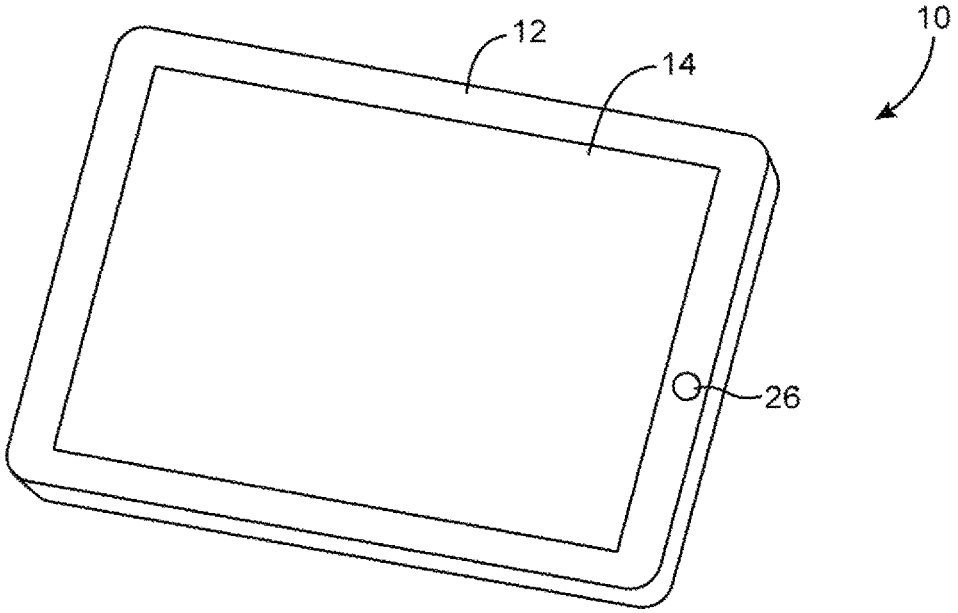
FIG. 3 is a perspective view of an illustrative electronic device such as a tablet computer with a display in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
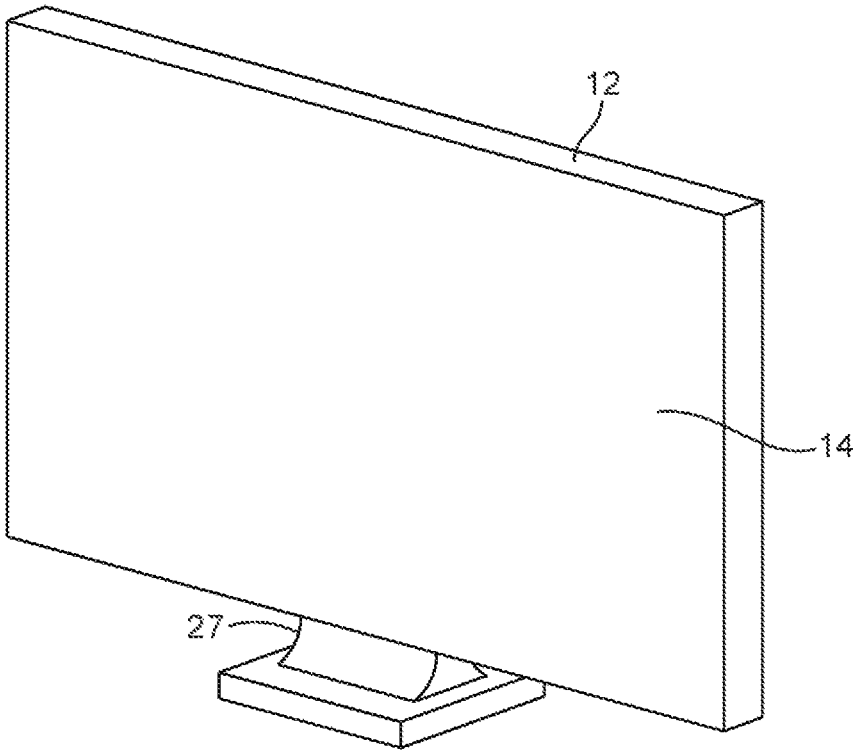
FIG. 4 is a perspective view of an illustrative electronic device such as a computer display with a display in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 includes display pixels formed from organic light-emitting diode (OLED) display components or other suitable display pixel structures.

Figure 5:
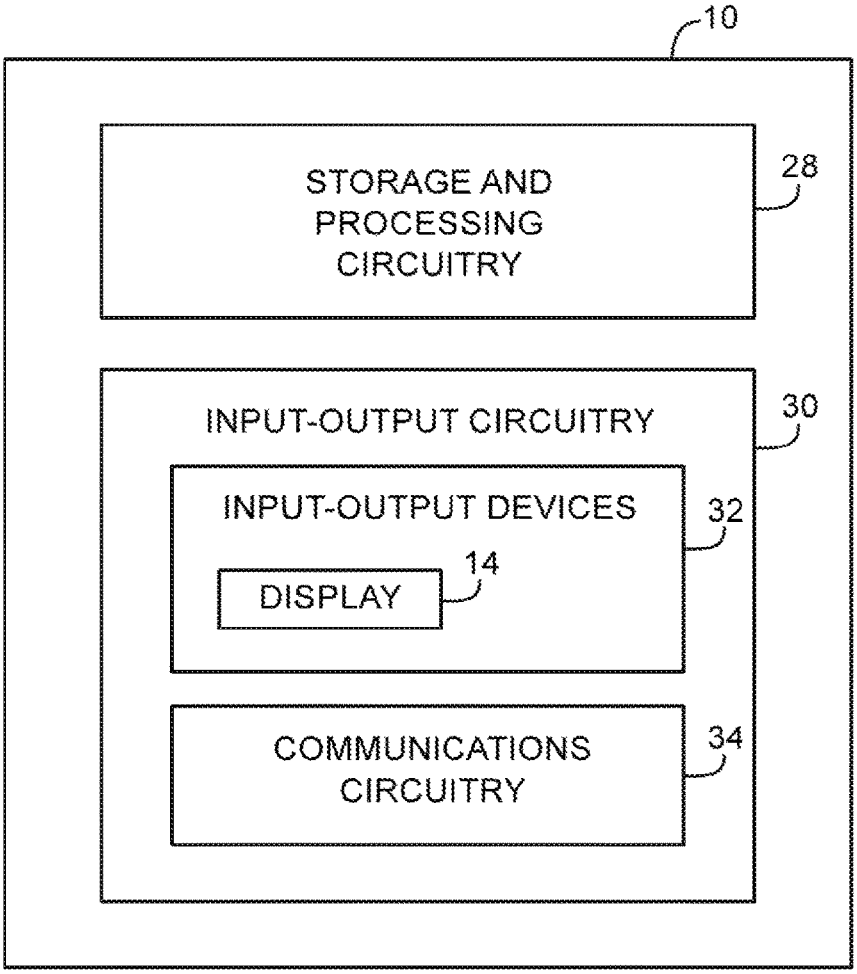
FIG. 5 is a schematic diagram of an illustrative electronic device with a display in accordance with an embodiment of the present invention.

A schematic diagram of an illustrative configuration that may be used for electronic device 10 is shown in FIG. 5. As shown in FIG. 5, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc. If desired, storage and processing circuitry 28 may include a system-on-chip integrated circuit or multiple system-on-chip devices.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may supply display 14 with content that is to be displayed on display 14. The content may include still image content and moving image content such as video content for a movie, moving graphics, or other moving image content. Image data for the content that is being displayed by display 14 may be conveyed between control circuitry 28 and display driver circuitry in display 14 over a data path (e.g., a flexible circuit cable with multiple parallel metal traces that serve as signal lines or other suitable communications path).

Control circuitry 28 and/or display driver circuitry in display 14 may be used controlling the display of information on display 14 in a way that minimizes the effects of burn-in. In minimizing burn-in effects, control circuitry 28 and/or display driver circuitry in display 14 may implement brightness control functions and peak luminance control functions. Control circuitry 28 and/or display driver circuitry in display 14 may, if desired, map bright pixel data values to dimmer pixel data values so that display pixel currents are reduced, particularly in conditions where the operating temperature of the display pixels of display 14 are elevated. Burn-in minimization operations may be performed in response to detecting static content on display 14 (e.g., a frame of static content, a portion of a frame with static content, a row or column of a display pixel array or a portion of a row or column of a display pixel array in display 14 that is static, etc.).

Input-output circuitry 30 may be used to allow data to be supplied to device 10 and to allow data to be provided from device 10 to external devices. Input-output circuitry 30 may include input-output devices 32. Input-output devices 32 may include one or more displays such as display 14 (e.g., an organic light-emitting diode display). Input-output devices 32 may also include touch screens, buttons, joysticks, click wheels, scrolling wheels, touch pads, key pads, keyboards, light-emitting diodes and other status indicators, data ports, etc. Input-output devices 32 may also include sensors and audio components. For example, input-output devices 32 may include an ambient light sensor, a proximity sensor, a gyroscope, an accelerometer, cameras, a temperature sensor, audio components such as speakers, tone generators, and vibrators or other audio output devices that produce sound, microphones, and other input-output components.

During operation, a user can control the operation of device 10 by supplying commands through input-output devices 32 and may receive status information and other output from device 10 using the output resources of input-output devices 32.

Communications circuitry 34 may include wired and wireless communications circuitry for supporting communications between device 10 and external equipment.

Figure 6:
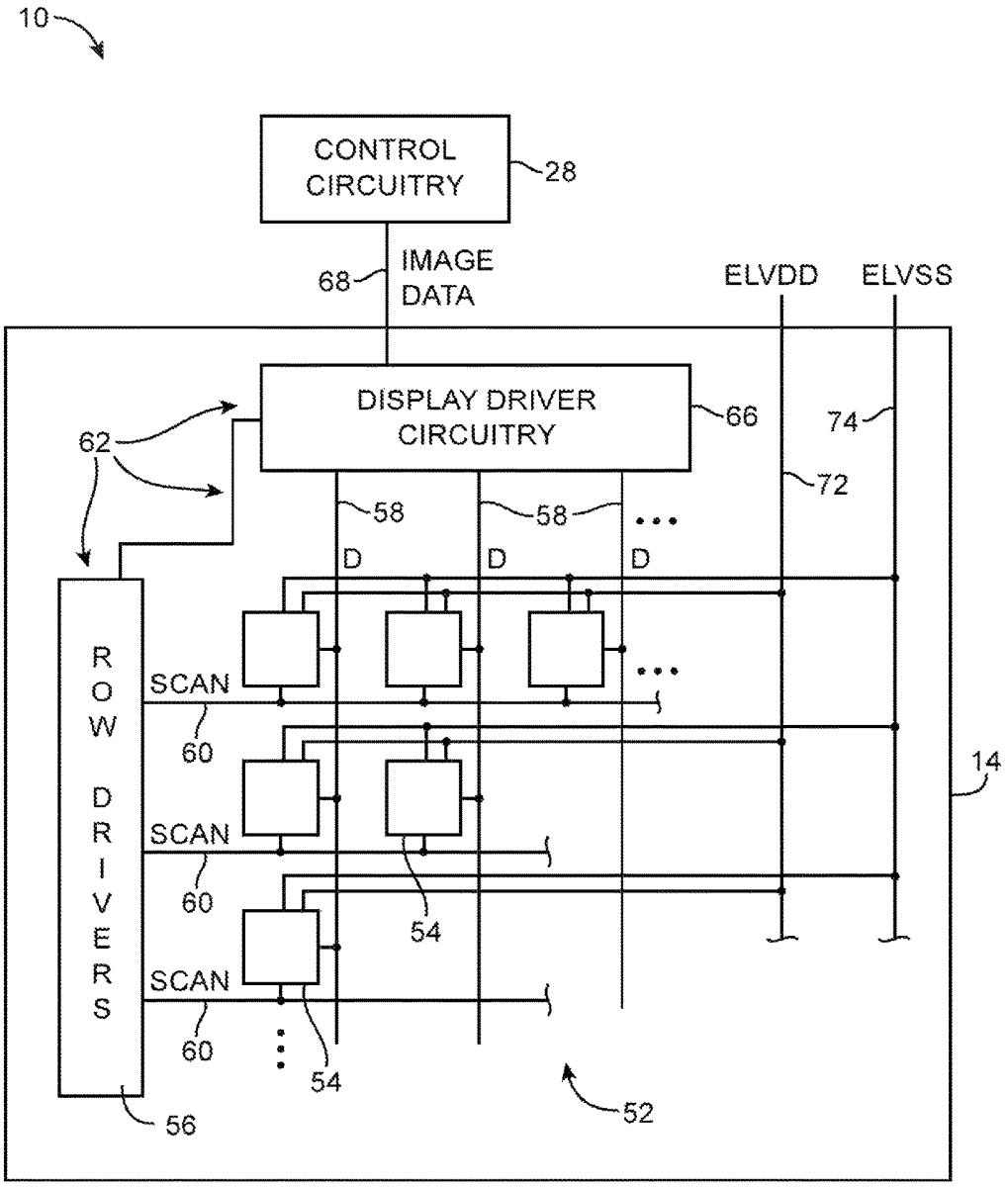
FIG. 6 is a diagram of display circuitry in accordance with an embodiment of the present invention.

A circuit diagram of display 14 and other circuitry in device 10 is shown in FIG. 6. As shown in the illustrative configuration of FIG. 6, display 14 may have display pixels 54 organized in an array such as display pixel array 52. Display pixel array 52 may contain rows and columns of organic light-emitting diode display pixels 54 (e.g., tens, hundreds, or thousands or more rows and/or columns). Display driver circuitry 62 may include display driver circuitry 66. Display driver circuitry 66 may be implemented using an integrated circuit (e.g., display driver circuitry 66 may include a display driver integrated circuit). Display driver circuitry 66 may include timing controller circuitry and may therefore sometimes be referred to as a timing controller (ICON) chip or timing controller integrated circuit.

Display driver circuitry 62 may include display driver circuitry 66, row driver circuitry 56, and column driver circuitry. Row driver circuitry 56 may, if desired, be implemented using thin-film transistor circuitry on the substrate of display 14 or other circuitry (e.g., circuitry in an integrated circuit). Thin-film transistor circuitry may also be used to form array 52. The column driver circuitry for display 14 may, as an example, be formed using an integrated circuit that is mounted on the substrate of display 14.

Column driver circuitry may be implemented in an integrated circuit (e.g., a column driver integrated circuit—sometimes referred to as a source driver) that is separate from a timing controller integrated circuit that is being used to implement display driver circuitry 66 or may be formed as an integral part of a timing controller integrated circuit used in implementing display driver circuitry 66.

Display driver circuitry 62 (e.g. display driver integrated circuit 66) may receive still and/or moving image data (sometimes referred to as display or image data) from control circuitry 28 using communications path 68. In response, display driver circuitry 62 may provide control signals to pixels 54 on lines 58 and 60. In particular, display driver circuitry 62 may provide corresponding analog data signals D on data lines 58 and may use row drivers 56 to provide scan signals SCAN on scan lines 60. There may be a different respective data line 58 for each column of display pixels 54 in display pixel array 52 and a different respective scan line 60 for each row of display pixels 54.

Power can be provided to display 14 using a power management unit integrated circuit. A power management unit may, for example, provide each of the display pixels 54 in display pixel array 52 with a positive power supply voltage ELVDD using positive power supply path 72 and a ground power supply voltage ELVSS using ground power supply path 74.

Display driver circuitry 66 may analyze image data from control circuitry 28 that is received over path 68. This analysis may, for example, reveal information on the content of the image data such as the average luminance of each frame of the image data. Using information such as average luminance information, display driver circuitry 66 can implement functions such peak luminance control functions. Brightness control functions may be used to adjust display brightness based on manual user input and/or ambient light sensor data (as examples).

Display driver circuitry 66 (or, if desired, control circuitry 28) can also analyze image data to detect the presence of static data (e.g., display pixel data that does not change between data frames). Static data may be detected by analyzing frames of data to determine whether the entire frame is remaining static or may be detected by analyzing regions of a frame. For example, display driver circuitry 66 may analyze rectangular regions of display pixels, rows or columns of data, or image data associated with other display regions to determine whether that particular region of data in a frame is remaining static. When static image data is detected, image burn-in minimization techniques may be used to reduce display pixel currents to safe levels.

Figure 7:
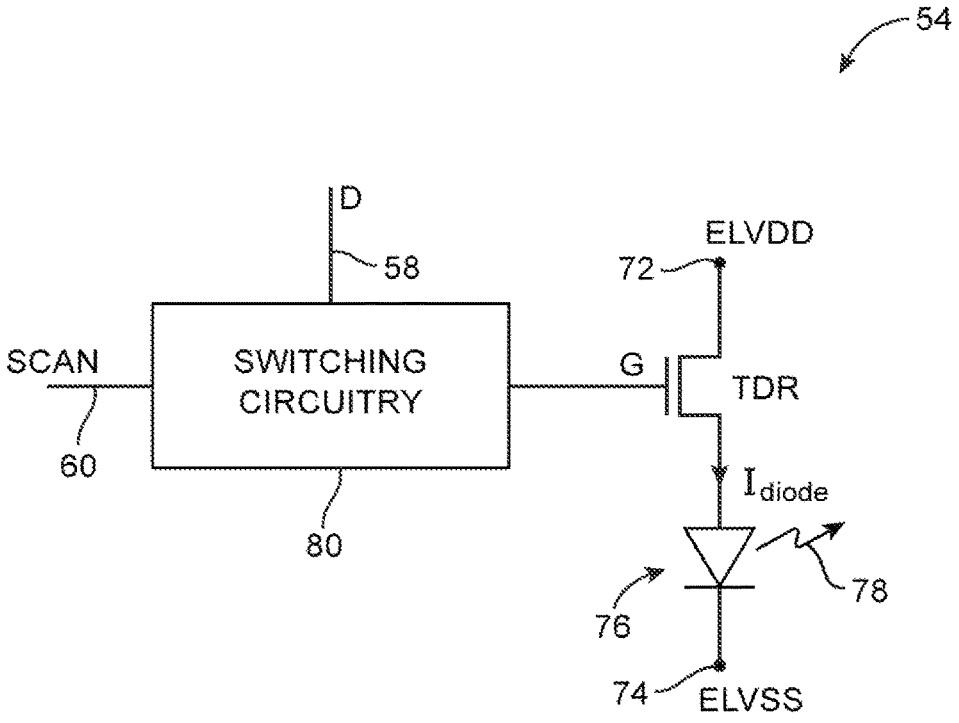
FIG. 7 is a schematic diagram of an illustrative organic light-emitting diode display pixel in accordance with an embodiment of the present invention.

A circuit diagram of an illustrative display pixel in display pixel array 52 of display 14 is shown in FIG. 7. The circuitry of illustrative display pixel 54 of FIG. 7 contains thin-film transistor switching circuitry 80 for controlling the application of data signal D to gate G of drive transistor TDR in response to scan signal SCAN. Transistor TDR is used to apply current Idiode to organic light-emitting diode 76. The amount of light 78 that is produced by light-emitting diode 76 can be adjusted by adjusting the magnitude of current Idiode. The FIG. 7 example includes current regulating (drive) transistor TDR and switching circuitry 80. This is merely illustrative. Other configurations may be used for the circuitry of display pixel 54 if desired. In general, display pixel 54 may contain any suitable number of transistors (e.g., two or more, three or more, four or more, five or more, six or more, etc.). Capacitor structures may, if desired, be used to store data on a pixel between successive frames.

During operation, data signal D is applied to switching circuitry 80. Scan line signal SCAN on scan line 60 may be asserted (taken high) when it is desired to pass data D into display pixel 54. Scan line 60 may serve as a scan input terminal for display pixel 54. A storage capacitor may help store the data signal in display pixel 54 between successive frames of data.

Transistor TDR and diode 76 are connected in series between positive power supply terminal 72 and ground power supply terminal 74. The drain terminal of transistor TDR is coupled to positive power supply terminal 72 and the source terminal of transistor TDR is coupled to light-emitting diode 76 at the anode terminal of light-emitting diode 76. The cathode terminal of light-emitting diode 76 is coupled to ground power supply terminal ELVSS. Positive power supply voltage terminal 72 may receive positive power supply voltage ELVDD. Ground power supply voltage terminal 74 may receive ground power supply voltage ELVSS. The voltage that is applied to gate G of transistor TDR by switching circuitry 80 controls the magnitude of diode current Idiode and therefore the amount of light 78 that is emitted by display pixel 54.

If care is not taken, the performance of a display pixel can deteriorate when operated for extended periods of time at large values of diode current Idiode, particularly under conditions where the temperature of diode 76 is elevated. Static image content on display 14 that produces elevated Idiode values therefore may undesirably burn images into display 14. To avoid undesired image burn-in effects, display driver circuitry 66 may detect the presence of static image content and may take appropriate actions to adjust the drive currents to the diodes in the pixel array to minimize image burn-in effects. For example, display driver circuitry 66 may reduce the drive currents Idiode in some or all of pixels 54 using display brightness adjustments, using adjustments to a peak luminance value in a peak luminance control algorithm, or by mapping bright display pixel data values to less bright display pixel values.

Figure 8:
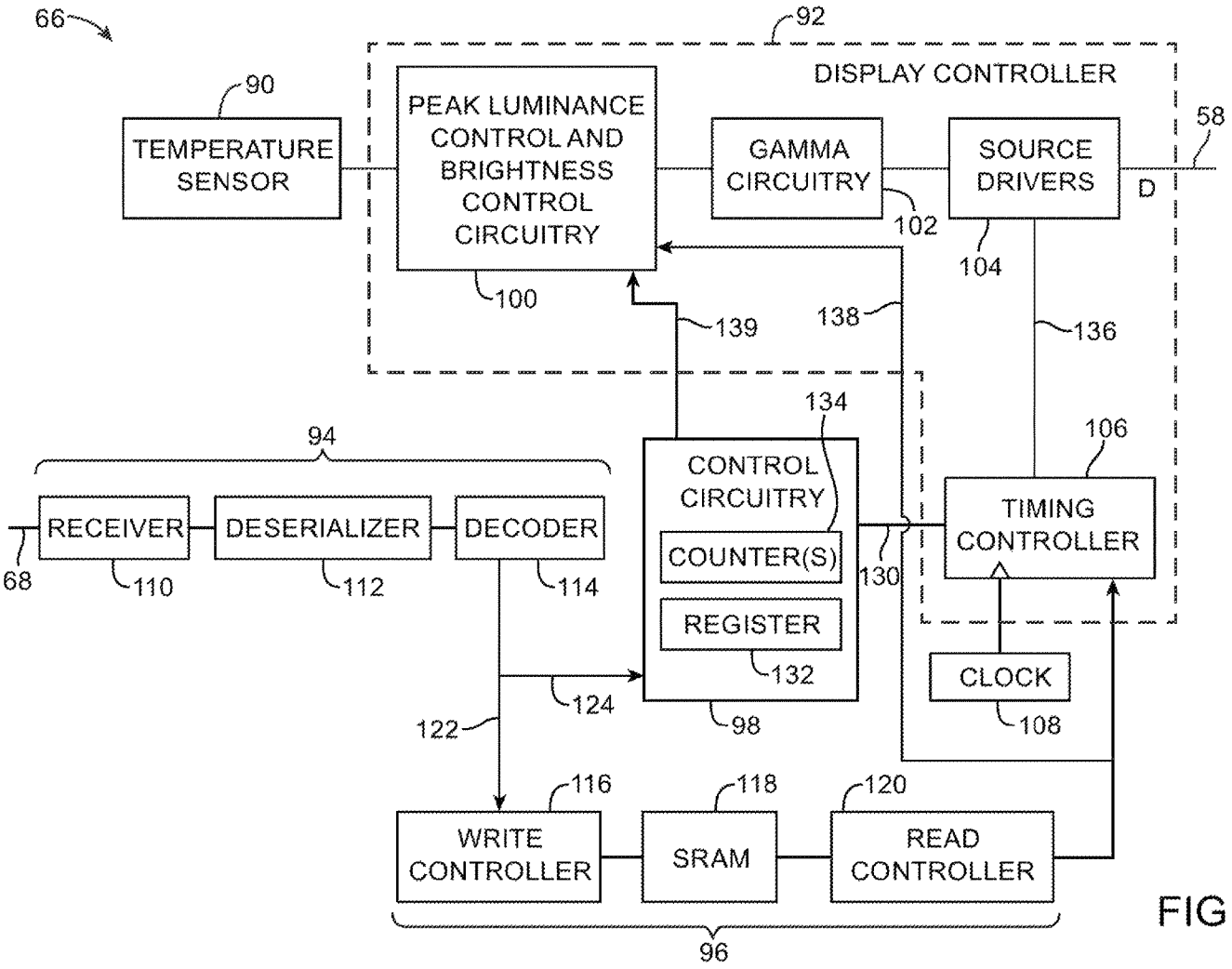
FIG. 8 is a diagram of illustrative display driver circuitry in accordance with an embodiment of the present invention.

Illustrative display driver circuitry of the type that may be used in implementing display driver circuitry 66 of FIG. 6 is shown in FIG. 8. As shown in FIG. 8, display driver circuitry 66 may include display controller circuitry such as display controller 92 for controlling the display of image data on display 14. Display controller 92 may supply data signals D for display pixel array 52 using output 58.

Display driver circuitry 66 may have an input such as input 68 for receiving image data from control circuitry 28. During operation of device 10 and display 14, communications circuitry 94 may receive image data on path 68 and may store received frames of image data in memory circuitry 96. Communications circuitry 94 may include receiver 110 for receiving data on path 68, deserializer 112 for deserializing the received data (i.e., for performing serial to parallel data conversion operations), and decoder 114. Each time control circuitry 28 (e.g., a system-on-chip circuit or other control circuitry) updates display 14 with a new frame of data, communications circuitry 94 receives the frame of data via path 68. Decoder 114 stores the received frame of data in memory circuitry 96 by issuing a write command on path 122.

Memory circuitry 96 includes write controller 116, random-access memory 118 (e.g., static random access memory), and read controller 120. Write controller 116 stores frames of data in memory 118 in response to write commands received from decoder 114 via path 122. Read controller 120 continuously reads data from memory 118 for displaying on display pixel array 52.

Clock 108 provides clock signals to timing controller circuit 106 (e.g., a display controller circuit). Clock 108 may contain an oscillator and a divider that reduces the frequency of the oscillator signal to a desired clock rate. Timing controller 106 may provide a frame clock signal (e.g., a 60 Hz clock or other appropriate clock signal) to control circuitry 98 via path 130. Control circuitry 98 may include a counter such as counter 134 that counts at the frame clock rate received from path 130. Counter 134 may be, for example, a countdown timer that counts down to zero from a timeout value that is stored in register 132 (i.e., a countdown timer that expires upon counting down to zero from the timeout value).

Control circuitry 98 may detect static content in the image data being provided on path 68 using countdown timer 134. Using path 124, control circuitry 98 may monitor decoder 114. Each time a new frame of data is written into memory 118 by decoder 114, decoder 114 issues a write command on path 122. Control circuitry 98 may monitor the status of the write commands being issued by decoder 114 using path 124. Whenever a write command is detected on path 124 (indicating that a write command has been provided from decoder 114 to write controller 116 via path 122), control circuitry 98 may reset countdown timer 134.

If display 14 is displaying static content such as a static array of menu options or selectable icons, no updated frames of data will be supplied to display driver circuitry 66 on path 68 and, as a result, decoder 114 will not issue write commands on path 122. Control circuitry 98 can detect that no write commands are being issued on path 122 by monitoring path 124. So long as no new frames of data are being provided to display driver circuitry 66, control circuitry 98 may decrement countdown timer 134.

When the amount of time specified by the timeout value in register 132 has been reached, display driver circuitry 66 can conclude that display 14 is displaying static content on display pixels 54 in array 52 and can take appropriate action if warranted (e.g., diode currents can be reduced if warranted by operating conditions).

Timing controller 106 may display data on display pixels 54 of array 52 by providing data to source drivers 104 via path 136. In response to receive of data from timing controller 106 on path 136, corresponding analog data signals D may be supplied by source driver circuitry 104 to display pixel array 52 via lines 58.

The relationship between the value of the digital data supplied by timing controller 106 and the resulting luminance of display pixels 54 (i.e., the magnitude of analog data signals D) is defined by a function that is sometimes referred to as a gamma curve. Gamma circuitry 102 may contain a resistor ladder that helps define the shape of the gamma curve. Using multiplexing circuitry that is responsive to the digital data from timing controller 106, gamma circuitry 102 and source driver circuitry 104 may drive analog output signals D onto the lines of path 58.

Peak luminance control and brightness control circuitry 100 may be used to implement display brightness control functions. For example, circuitry 100 may be used in making display brightness adjustments responsive to user brightness settings input and/or automatic brightness levels determined using ambient light measurements from an ambient light sensor. Data from read controller 120 may be received by peak luminance control and brightness control circuitry 100 via path 138. Circuitry 100 can process the image data from read controller 120 and can compute image data parameters such as average luminance values for received data frames.

Based on average luminance values for the frames of data that are being displayed on array 52 or other information, circuitry 100 may control peak luminance values for display 14. If, for example, average luminance is high, a peak luminance control algorithm that is implemented on circuitry 100 may select a gamma curve using gamma circuitry 102 that is appropriate for displaying image data with a reduced peak luminance. When average luminance is low, the peak luminance control algorithm may select a different gamma curve. In addition to adjusting diode currents Idiode in array 52 by implementing different peak luminance values using a peak luminance control algorithm, circuitry 100 may adjust diode currents by adjusting display brightness settings. Brightness control (e.g., global dimming or brightening of all of the display pixels 54 in array 52) may, for example, be performed by circuitry 100 in response to user dimming settings and/or ambient light data from an ambient light sensor.

Information from temperature sensor 90 may be gathered to assess the current operating temperature of display 14. When display 14 is operated at an elevated temperature relative to room temperature, there is an increased risk of image burn-in effects. Accordingly, more significant diode current reductions may be made to avoid burn-in effects whenever elevated temperatures are detected. The criteria by which static content is detected may also be temperature dependent. For example, the timeout value for countdown counter 134 that is stored in register 132 (and which represents the amount of time that passes before unchanging data is considered to be sufficiently static to warrant taking remedial actions) may be varied as a function of temperature. At lower temperatures, more static content can be tolerated, so the timeout value can be longer. At higher temperatures, display 14 is more sensitive to burn in, so the duration over which static content can be tolerated is reduced and the timeout value stored in register 132 can be lowered.

Figure 9:
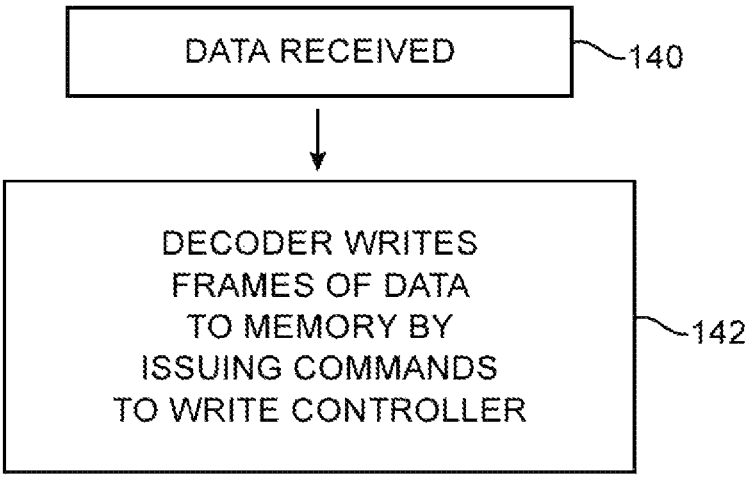
FIG. 9 is a flow chart of illustrative steps involved in writing data into memory in a display driver integrated circuit in accordance with an embodiment of the present invention.

FIG. 9 is a flow chart of illustrative steps involved in storing image data in display driver circuitry 66. The operations of FIG. 9 may be performed continuously while images are being displayed on display 14. At step 140, control circuitry 28 may provide image data to display driver circuitry 66 over communications path 68. Communications circuitry 94 in display driver circuitry 66 may receive the image data using receiver 110. Deserializer 112 may be used to perform a serial to parallel conversion on the received image data. As each new frame of data is received by receiver 110 and deserializer 112, decoder 114 may issue commands to write controller 116 to store the received frame of data in memory 118 (step 142).

Figure 10:
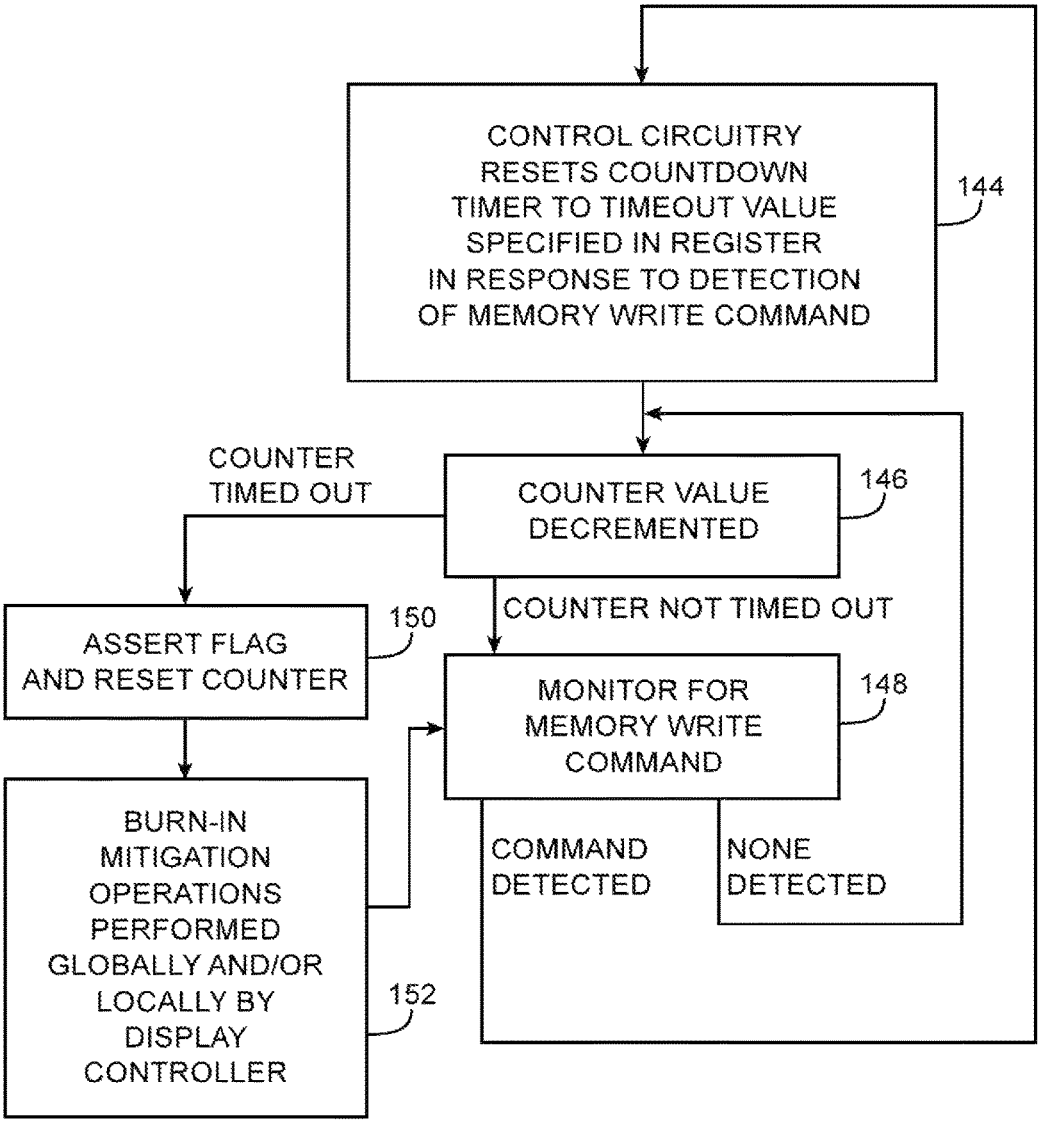
FIG. 10 is a flow chart of illustrative steps involved using display driver circuitry to identify static display frame content and reduce the effects of image burn-in in accordance with an embodiment of the present invention.

FIG. 10 is a flow chart of illustrative steps involved in displaying the data that is being stored in memory 118 using the process of FIG. 9. When decoder 114 issues a memory write command on path 122, a new frame of data is being stored in memory 118, so the content on display 14 is not static. Accordingly, control circuitry 98 may, in response to detection of a memory write command on path 124 at step 144, reset countdown timer 134 to a timeout value (count value) that is stored in register 134. The timeout value that circuitry 66 stores in register 132 may be selected independent of temperature or may be based on temperature measurements from temperature sensor 90. For example, the timeout value, which represents that amount of time that is allowed to pass before content is considered to be sufficiently static to make adjustments to limit diode currents Idiode, may be set to a lower magnitude at higher temperatures than at lower temperatures.

At step 146, countdown timer 134 may be decremented. For example, if the current count of countdown timer 134 is N, at step 146, the count of countdown timer 134 may be decreased to N−1.

If the decremented count value of countdown timer 134 is positive (i.e., if the counter has not yet timed out), processing may continue at step 148. During step 148, control circuitry may monitor path 124 for the presence of a memory write command from decoder 114. If decoder 114 is not issuing a memory write command, control circuitry 98 may conclude that the content of memory 118 is not being updated with a new frame of data (i.e., the image is remaining in a static unchanged state). Additional counting with the countdown timer is therefore appropriate and processing may loop back to step 146. If, control circuitry 98 detects that decoder 114 has issued a write command indicating that decoder 114 has stored updated image data for a frame in memory 118, control circuitry 98 can conclude that the frame of data in memory 118 is not static and can reset the countdown timer at step 144.

When content remains static for the entire duration of the timeout value (i.e., when the counter value is decremented at step 146 to a zero value), processing may continue at step 150. During the operations of step 150, control circuitry 98 may assert a static image data present flag on path 139 or may otherwise produce output to indicate that the timeout condition has been satisfied (i.e., to indicate that the timeout time has expired).

Because the countdown timer has counted down from the timeout value to zero without any memory write commands being issued, circuitry 66 can conclude that the data frame in memory 118 has remained in a static state for the entire timeout time period. This indicates that there is a risk for image burn-in effects unless corrective actions are taken. Accordingly, at step 152, device 10 may take appropriate actions. During the operations of step 152, for example, circuitry 66 (e.g., display controller 92) may evaluate the static frame data to determine whether the data contains bright pixels (i.e., bright data). Circuitry 66 (e.g., display controller 92) may also, if desired, determine the current brightness setting for display 14. The current operating temperature may also be obtained from temperature sensor 90.

In response to detecting that the image data in memory 118 is static (i.e., in response to recognizing that the image data is sufficiently static to warrant taking corrective actions by detecting assertion of the static content flag on path 139 or other information from control circuitry 98), display controller 92 can reduce the likelihood of burn-in damage to display pixels 54 by taking steps to reduce some or all diode currents in array 52. Actions that may be taken to reduce the potential for burn-in include directing circuitry 100 to reduce peak luminance in the display (e.g., by selecting a gamma curve with a lowered peak luminance value), directing circuitry 100 to reduce screen brightness (e.g., by reducing a global brightness setting value), and directing timing controller 106 or other resources in display controller 92 to map data values for bright pixels (and/or other pixels) to less bright data values (e.g., using timing controller 106).

These diode current (Idiode) reduction operations may be taken only when elevated temperatures are detected using temperature sensor 90 or the magnitude and/or type of diode current reduction operation that is performed may be dependent on temperature. For example, at moderate temperatures, circuitry 100 may reduce screen brightness to a moderate level and/or may select a gamma curve that exhibits a moderate peak luminance value, whereas at high temperatures, circuitry 100 may reduce screen brightness to a low level and/or may select a gamma curve that exhibits a low peak luminance value. If desired, the operations that are taken to reduce diode currents to avoid burn in may be insensitive to temperature.

In some situations, part of the image data on array 52 may be static and part of the image data on array 52 may be dynamic. In situations such as these, updated frames of data may be repeatedly stored in memory 118 to ensure that the dynamic part of the image data is properly updated. Nevertheless, there may be a risk of burn-in damage due to the static portion of the image data. To help prevent this type of damage, circuitry 66 may, if desired, divide array 52 into multiple regions each of which may be independently monitored for static content.

For example, array 52 may be divided into a three-by-three array of subregions. Each of these nine subregions in array 52 may be monitored for static content using a respective countdown timer 134. When static content in any of the nine subregions is detected (i.e., when the countdown timer for one of the nine subregions expires), a static content detection flag may be asserted, as described in connection with the assertion of the static content detection flag on path 139 by control circuitry 98. In response to assertion of this flag, display controller 92 can take appropriate action (e.g., by locally dimming display 14 in the static region, by locally dimming display 14 in another region, by globally dimming display 14, by locally or globally reducing the peak luminance value, etc.).

If desired, localized static content may be detected by processing each row (or column) of image data separately. As an example, an exclusive OR operation or other checksum operation may be performed on each row of a frame of image data as that frame of image data is being stored in memory 118. Historical checksum information may also be maintained for each row. Additional columns may be provided in memory 118 to store the current frame checksum and historical checksum information. When the checksum for the current frame and historic checksum do not match each other, circuitry 66 can conclude that the image data for that row is changing. When the checksum for the current frame and the historic checksum match each other, circuitry 66 can conclude that the data in the row (or column) on which that checksum was computed has not changed and is therefore static. When data persists for sufficiently long (e.g., a timeout value stored in a register), circuitry 66 (e.g., display controller 92) may conclude that the data is sufficiently static to have a potential for causing burn-in effects and may take suitable action (e.g., by locally or globally dimming display pixels, by locally or globally reducing a peak luminance value using a peak luminance control algorithm, etc.).

During row-wise processing of the image data in a frame, the peak pixel value for that row can be computed. This value may be examined as part of a secondary check to determine whether burn-in minimization operations should be performed. If static data is dim (e.g., if a static row of black pixels or other low-pixel-value pixels is detected), it is not necessary to perform any brightness dimming or peak luminance value reduction operations. This type of diode current reduction operation is preferably only performed when there is a risk of burn in (i.e., when pixel data values are high, the display has been set to a relatively high display brightness setting, and, if desired, an optional threshold operating temperature has been exceeded).

If desired, other types of regions may be analyzed for static content (e.g., columns of data, multiple rows or multiple columns of data, diagonal strips of data, rectangular regions of data, etc.).

Figure 11:
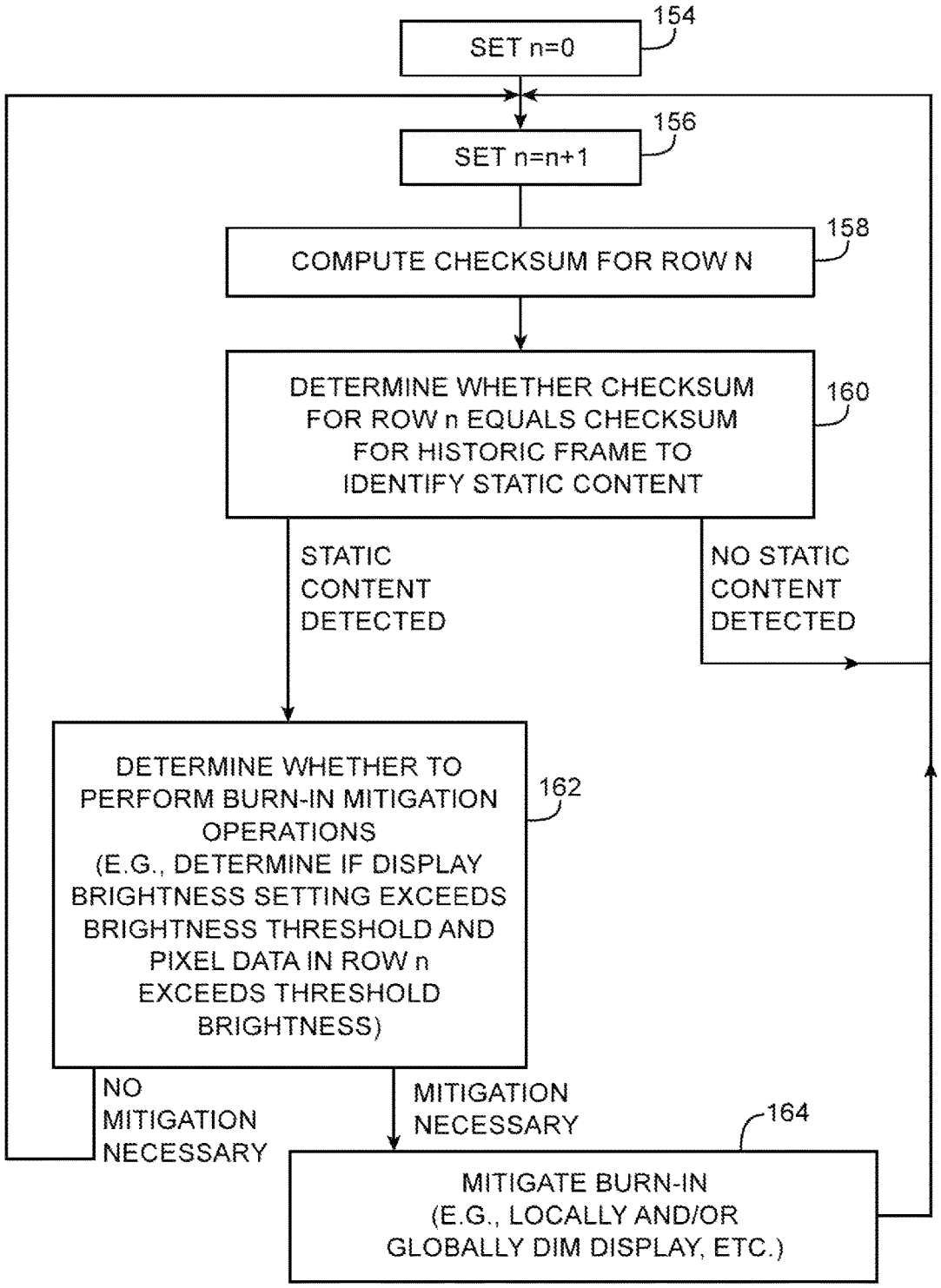
FIG. 11 is a flow chart of illustrative steps involved using display driver circuitry to identify static display content such as a row of static pixels and to mitigate the effects of burn-in in accordance with an embodiment of the present invention.

FIG. 11 is a flow chart of illustrative steps involved in analyzing pixel data for an image to determine whether steps should be taken to avoid burn-in effects. In the example of FIG. 11, rows of image data are being analyzed. Other regions of data in a display frame may be analyzed, if desired.

At step 154, a row index (n) may be initialized. For example, the value of n may be set to zero.

At step 156, the row index may be incremented (e.g., n may be set to n+1).

At step 158, the display pixels in row n of a current frame of image data in circuitry 66 may be analyzed. For example, an exclusive OR operation may be performed on the display pixel data in row n or other checksum operations may be performed on the display pixel data values in row n.

After computing the exclusive OR value or other checksum for row n during the operations of step 158, the operations of step 160 may be performed to detect whether static content is present. For example, during step 160, circuitry 66 can determine whether the checksum that has been computed for row n in the current frame is the same as a historical checksum value for row n (i.e., the checksum value for the row from an earlier frame). If the checksum values differ, some of the data in the row has changed, and the row is therefore not static. If the checksum values are the same, the content is of row n is static. Content can be considered to be static when the checksum remains constant between a pair of successive frames or when the checksum remains constant for a larger number of frames (as examples).

If the content of row n is not static, processing may loop back to step 156.

In response to determining that the content of row n is static at step 160, processing can proceed to step 162.

During the operations of step 162, circuitry 66 may perform secondary checking operations to determine whether the row with the detected static content (i.e., row n) has other attributes that warrant corrective action. In particular, the operations of step 162 may be used to determine whether the display brightness setting for display 14 is sufficiently high to warrant concern (i.e., whether the display brightness setting exceeds a predetermined display brightness threshold) and whether the pixel data in row n is sufficiently bright to warrant concern (i.e., whether pixel data in row n has a luminance value that exceeds a predetermined threshold brightness).

If the display has a dim setting (i.e., if the user or an automatic brightness circuit has set the display to a low brightness level) or if the data being displayed for row n is itself dim (i.e., if black or other dark colors are being displayed), there is no need to take corrective action to prevent burn-in effects and processing may return to step 156.

If, however, the display brightness exceeds the predetermined display brightness threshold and at least some of the data being displayed in the row is above the predetermined pixel data brightness threshold, circuitry 66 can take corrective action at step 164. For example, at step 164, circuitry 66 can locally (for the row or other region) and/or globally dim the display, implement a lowered peak luminance using peak luminance control algorithm, map data to lower brightness values, etc.

The test of step 162 may, if desired, include temperature information (i.e., burn-in mitigation operations may be performed only if a predetermined temperature is also exceeded). If desired, the actions that are taken at step 164 to reduce the effects of burn-in may be temperature dependent (e.g., the amount of display brightness reduction, the amount of peak luminance reduction, or the amount of display pixel data brightness reduction that is performed may be more significant in the presence of elevated temperatures and less significant in the presence of lower temperatures).

Figure 12:
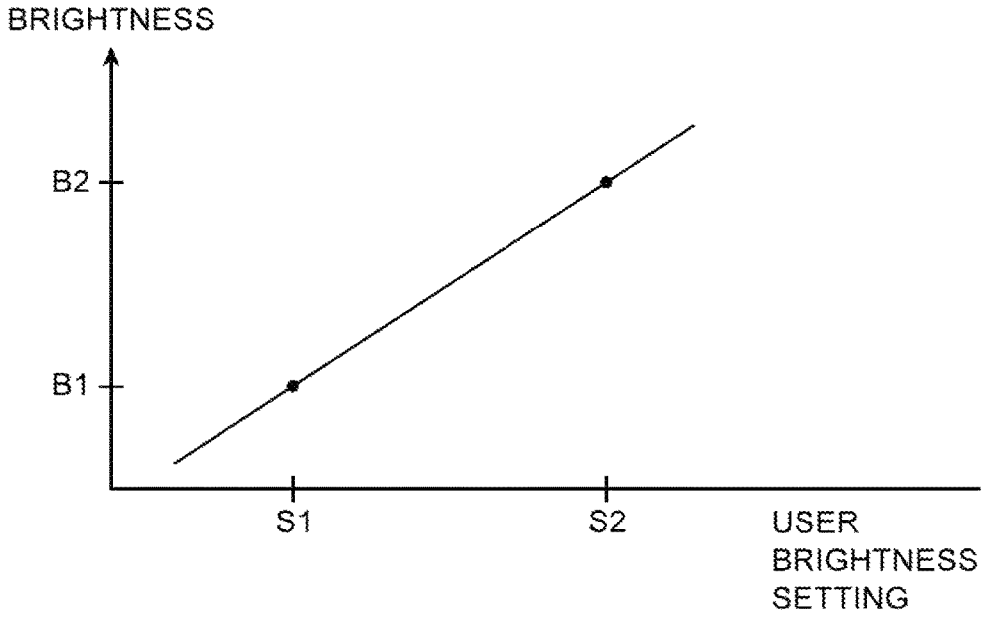
FIG. 12 is a graph showing how a display brightness setting may be adjusted to control display brightness in accordance with an embodiment of the present invention.

FIG. 12 is a graph showing how display brightness may be adjusted as a function of a display brightness setting (sometimes referred to as a user brightness setting). As illustrated by the FIG. 12 example, display 14 may exhibit a low brightness B1 at user brightness setting S1 and, when display brightness is set to user brightness setting S2, may exhibit a higher brightness B2. Device 10 may have an ambient light sensor and user input structures such as buttons and other input-output devices 32. Control circuitry 28 may adjust the brightness setting for display 14 based on ambient light readings from an ambient light sensor and/or may adjust display brightness based on manual user input. As an example, display brightness may be automatically dimmed when the ambient light level drops upon entering a building from a bright exterior environment. A user may also adjust a display to exhibit a lower or higher brightness setting by pressing "increase brightness" and "decrease brightness" buttons or by interacting with an interactive touch screen option such as a slider button (as examples).

Figure 13:
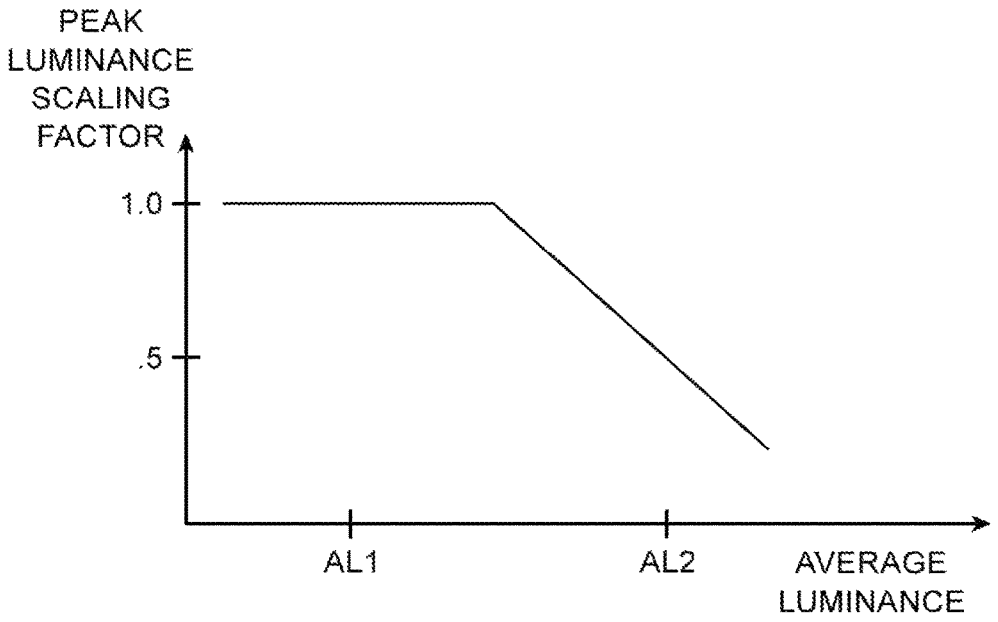
FIG. 13 is a graph showing how a peak luminance control algorithm may be used in controlling peak display luminance as a function of a parameter such as the average luminance of incoming data frames in accordance with an embodiment of the present invention.

To conserve power, it may also be desirable to use a peak luminance control algorithm to limit the amount of brightness in a display as a function of incoming image content or other parameters. The peak luminance control algorithm may, as an example, limit the peak luminance for display 14 as a function of the average luminance of incoming image data frames to the display. As shown in the illustrative peak luminance control algorithm graph of FIG. 13, at relatively low average luminance values such as average luminance value AL1, the peak luminance in the image data that is being displayed on display 14 may be unaffected by the peak luminance control algorithm (i.e., images may be displayed using a scaling factor of 1.0—indicating that no downwards adjustment is being made to the luminance of the image). On the other hand, when the incoming data to display 14 exhibits an average luminance of AL2, the peak luminance of the display may be reduced (e.g., by a scaling factor of 0.5) to limit current draw, power consumption, and heat generation in display 14.

Figure 14A:
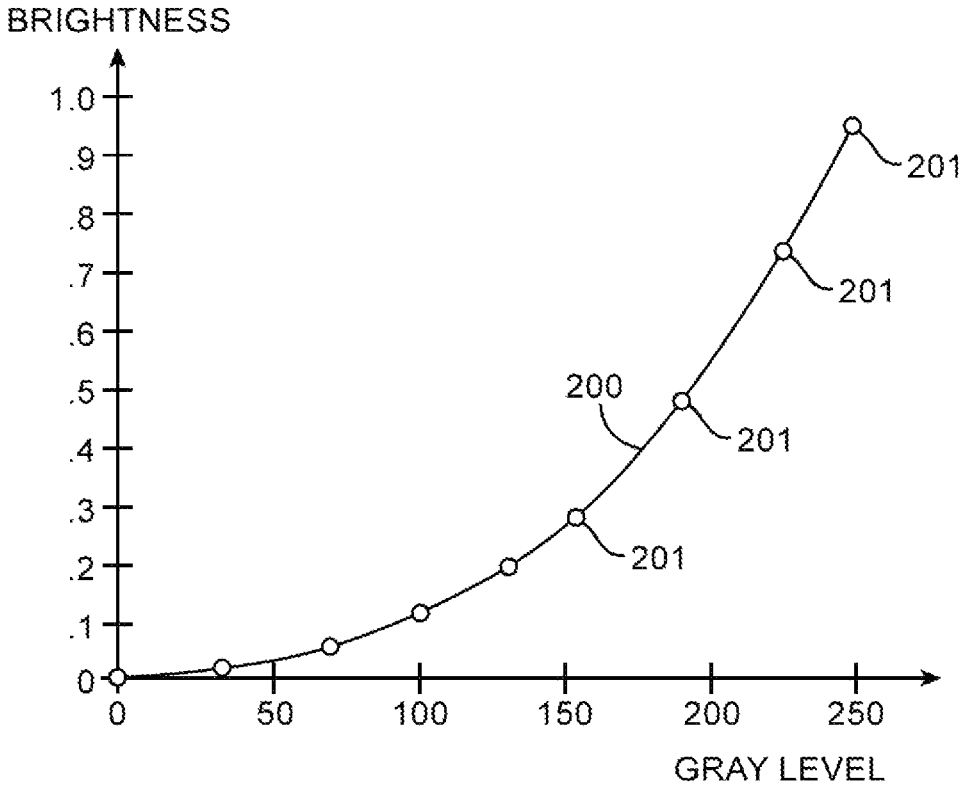
FIG. 14A is a graph of a gamma curve in which display brightness has been plotted as a function of the gray level associated with a digital input signal in accordance with an embodiment of the present invention.

To accurately represent images on display 14, display 14 uses gamma curve selection circuitry to implement an appropriate gamma curve shape under a variety of operating conditions. An illustrative gamma curve is shown in FIG. 14A. As shown in FIG. 14A, gamma curve 200 maps different digital gray levels in an image to corresponding brightness values for the display pixels in display 14. The shape of curve 200 may be coarsely defined by points 201, which may correspond to a set of digital-to-analog converter input voltages (V255, V191, . . . V0). In a color display, each color (red, green, and blue) may have a corresponding gamma curve. Maintaining a satisfactory gamma curve shape for each color under a variety of brightness and peak luminance control settings allows display 14 to present accurate images to a user. Care should be taken when adjusting gamma curve shape in response to different operating conditions. For example, linear scaling of a gamma curve when display brightness is reduced by 50% due to a user brightness change would result in suboptimal performance for a display.

Figure 14B:
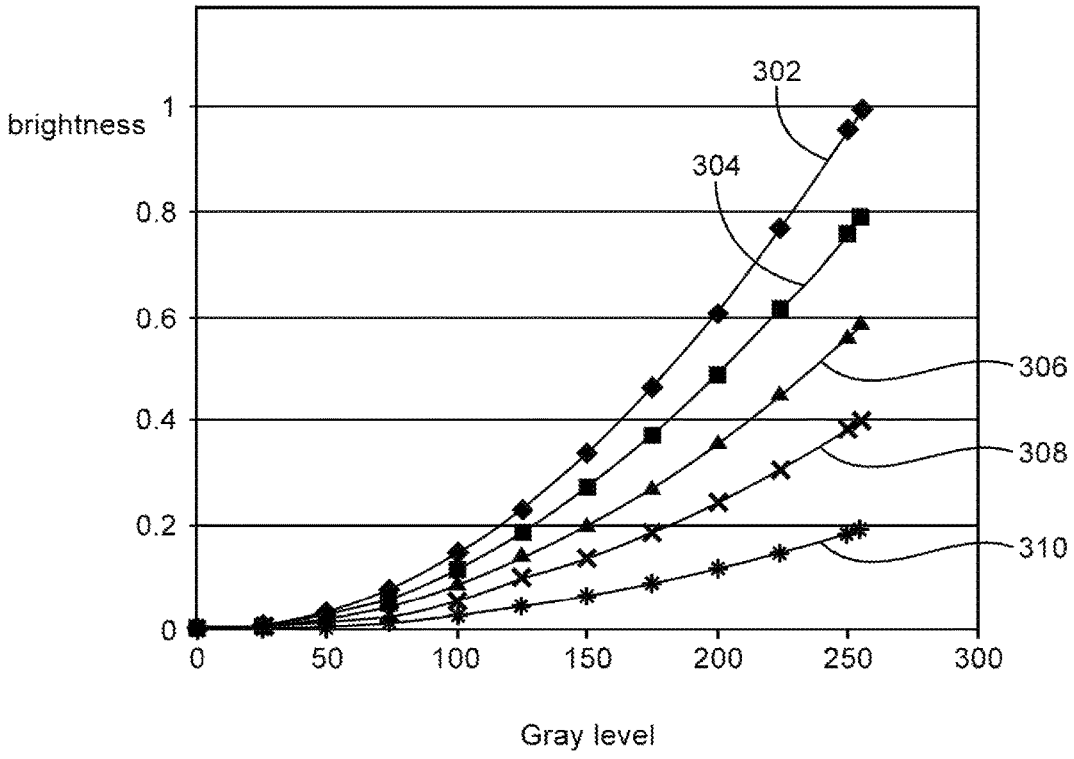
FIG. 14B is a graph of a gamma curve under various display settings in accordance with an embodiment of the present invention.

FIG. 14B is a graph of an illustrative gamma curve that is being adjusted in response to different operating conditions for display 14. With the arrangement of FIG. 14B, display 14 uses gamma curve 302 when a user sets the user brightness setting to a maximum value. If a user chooses an lower brightness setting, a gamma curve with a lower maximum brightness may be used, as shown by gamma curves 204, 306, 308, and 310. In the absence of a peak luminance control algorithm in display 14, curve 304 will always be used. When using a peak luminance control algorithm, the gamma curve that is used may be selected as a function of average luminance (AL) in the frames of image data being displayed on display 14. If, for example, the average luminance is sufficiently low, gamma curve 302 may be used. If the average luminance is higher than a given threshold, the peak luminance control algorithm will select an appropriate gamma curve to use based on the value of the average luminance. If, for example, the average luminance is significantly higher than the threshold, curve 310 may be used. If the average luminance is only slightly higher than the threshold, curve 304 may be used, etc.

Figure 15:
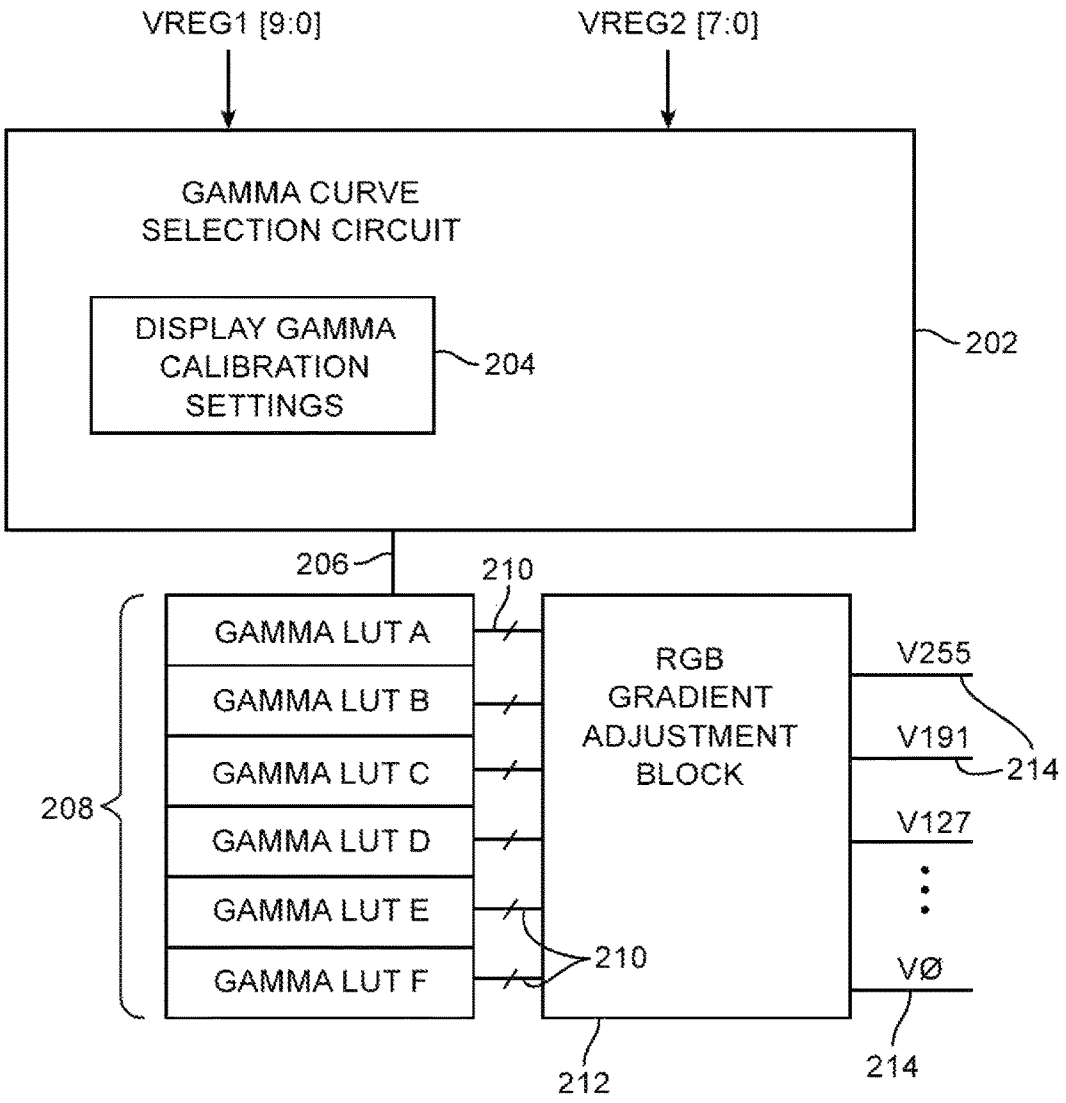
FIG. 15 is a diagram showing how a gamma curve selection circuit may be used in selecting an appropriate gamma curve for use in a display based on inputs such as a user brightness setting and a peak luminance control algorithm scaling factor in accordance with an embodiment of the present invention.

As shown in FIG. 15, display driver circuitry 66 may include a gamma curve selection circuit that receives both a user brightness setting VREG1[9:0] and a peak luminance control algorithm scaling factor setting VREG2[7:0}. Gamma curve selection circuit 202 may maintain display gamma calibration settings 204. Settings 204 may include manufacturing dependent variables that affect display gamma and can be used to calibrate display 14 for process and design variations.

Gamma curve selection circuit 202 can produce a control signal output on path 206 that is based on both the user brightness setting (from a user input-output device, from an ambient light sensor, etc.) and the peak luminance control algorithm output (i.e., a peak luminance control algorithm scaling factor). The control signal output on path 206 may be used to select from one of a plurality of gamma curve look-up tables. Each look-up table 208 may have settings for implementing a different respective gamma curve. For example, when a user brightness setting and a peak luminance control scaling factor setting are high, the control signals on path 206 may switch gamma look-up table A into use. When a user brightness setting and peak luminance control signal have low values, the control signals on path 206 may switch gamma look-up table F into use. Each look-up table corresponds to a respective gamma curve shape (and, if display 14 is a color display, may include gamma curve information for red, green, and blue display pixels).

Each look-up table 208 may supply corresponding output signals on a respective one of paths 210. These output signals serve as control signals that direct circuitry such as red-green-blue gradient adjustment block 212 to produce output voltages V255, V191, V127 . . . V0 on output lines 214. Gradient adjustment block 212 may also receive a voltage V255 that helps define the gamma curve from digital-to-analog converter circuitry.

The output voltages on paths 214 may be used to define the overall shape for the gamma curve for display 14. By interpolating between the voltages provided on paths 214, digital-to-analog converter circuitry can be being used in driving data signals D onto the array of display pixels in display 14 in accordance with the selected gamma curve. In this way, the selection of the gamma look-up table 208 by gamma curve selection circuit 202 results in the production of output voltages on paths 214 that serve to define the shape of gamma curve 200 (FIG. 14A). Interpolation between the voltages provided on paths 214 can be used to determine a corresponding brightness level on the gamma curve for each particular red, green, and blue digital input value that is being displayed.

Equation 1 shows how the voltages on output paths 214 (sometimes referred to as digital-to-analog converter input voltages because these voltages can be provided to digital-to-analog converter circuitry to define a gamma curve shape) may be computed as a function of user brightness setting VREG1 and peak luminance control algorithm scaling factor VREG2.

$$V255=(1+VREG1/C1)*VREG2/C2 \quad (1)$$

As shown in equation 1, illustrative voltage V255 (in this example) is a function of VREG1, VREG2, and constants C1 and C2. If desired, gamma curve selection circuit 202 may be configured to solve equation 1 (and the equations for the other voltages on paths 214 based on VREG1, VREG2, and optionally display gamma calibration settings 204. With this type of arrangement, circuitry 202 may be used to evaluate expressions (see, e.g., equation 1) that contain division and multiplication operations. Division operations can be computationally expensive, so efficiency in gamma curve selection circuit 202 may be enhanced by performing the divisions of equation 1 using bit shifting operations. Bit shifting division may not be as accurate as other division techniques (and may therefore sometimes be said to produce approximate division results), but can significantly enhance gamma curve selection efficiency.

Figure 16:
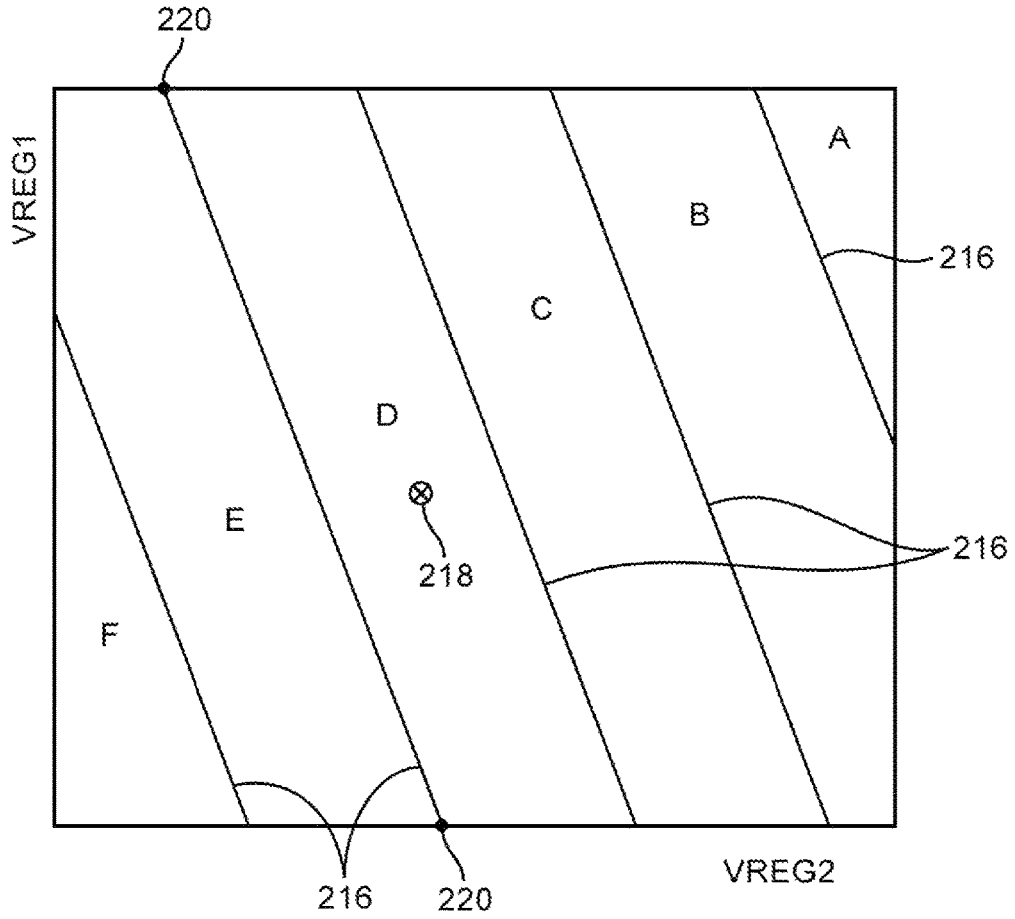
FIG. 16 is a graph showing how gamma curve selection circuitry such as the circuitry of FIG. 15 may be used in selecting an appropriate gamma curve lookup table for a display based on a user brightness setting and a peak luminance control algorithm scaling factor in accordance with an embodiment of the present invention.

If desired, an arrangement of the type shown in FIG. 16 may be used by gamma curve selection circuit 204 in selecting an appropriate gamma look-up table. Respective pairs of lines 216 define the borders of regions of VREG1 and VREG2 values corresponding to each look-up table 208. If, as an example, gamma curve selection circuit 202 receives VREG1 and VREG2 values corresponding to point 218, gamma curve selection circuit 202 may produce control signals on output 206 that switch gamma curve look-up table D into use. Lines 216 may be linear approximations and may be represented by respective endpoints 220 or endpoint and slope values. By using linear representations (i.e., linear approximations) of gamma curve region borders such as these, gamma curve selection efficiency may be enhanced.

The circuitry of FIG. 15 may be used in display driver circuitry 66 (see, e.g., peak luminance and brightness control circuitry 100 and gamma circuitry 102 of FIG. 8).

Figure 17:
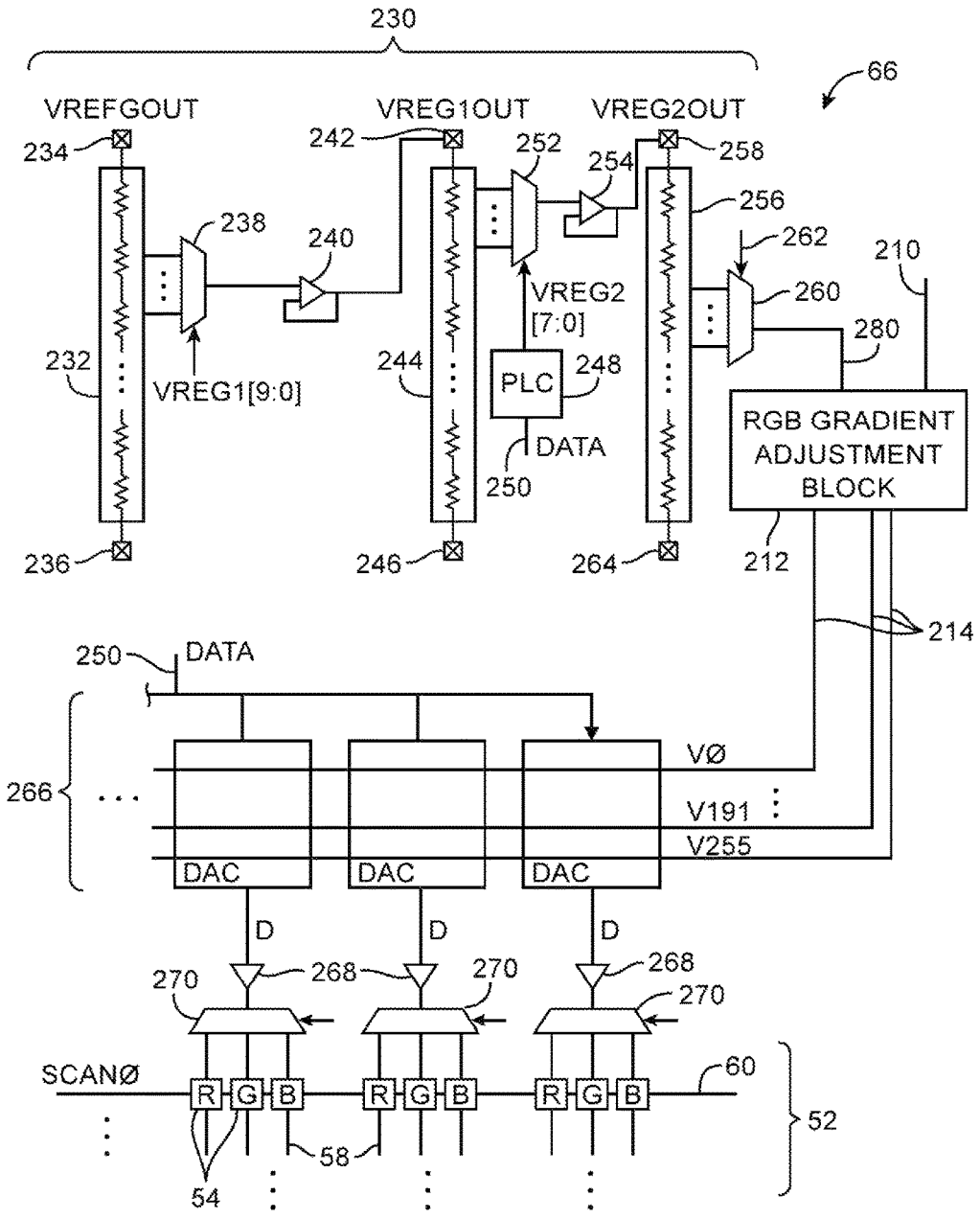
FIG. 17 is a circuit diagram of display driver circuitry that may be used in selecting a gamma curve for a display based on a user brightness setting and a peak luminance control algorithm scaling factor and that may be used in displaying data on a display using the selected gamma curve in accordance with an embodiment of the present invention.

Illustrative display driver circuitry 66 that may be used in displaying images on display 14 using a gamma curve selected based on inputs such as a display brightness setting and a peak luminance control scaling factor are shown in FIG. 17. As shown in FIG. 17, circuitry 230 may receive inputs such as display brightness setting VREG1[0:9] and peak luminance control scaling factor VREG2[7:0] and may produce corresponding output control signals on output 280 that direct RGB gradient adjustment block 212 to supply voltages V255, V191, . . . V0 on paths 214 to digital-to-analog converter circuitry 266. The magnitudes of the voltages on paths 214 are supplied to digital-to-analog converter circuitry 266 and define the gamma curve shape to be used for the given values of VREG1[0:9] and VREG2[7:0] that are supplied to circuitry 230, so these voltages may sometimes be referred to as digital-to-analog converter input voltages, gamma curve voltages, or gamma curve reference voltages.

Each digital-to-analog converter (DAC) in circuitry 266 receives voltages V255, V191, . . . V0 and uses these voltages in producing analog output signals D corresponding to digital input DATA on path 250 in accordance with the gamma curve shape that is defined by voltages V255, V191, . . . V0. The data signals D are distributed to red (R), green (G), and blue (B) display pixels 54 in display pixel array 52 using drivers 268 and time-division multiplexed demultiplexers 270.

In the illustrative configuration of FIG. 17, circuitry 230 includes digital-to-analog converter circuitry for converting digital inputs to analog outputs. For example, the digital input signal VREG1[9:0] that corresponds to the user brightness setting can be converted to an analog output signal VREG1OUT using digital-to-analog converter circuitry such as resistor ladder 232, multiplexer 238, and buffer 240. Resistor ladder 232 may be provided with a first voltage (VREFGOUT) on terminal 234 and a second voltage on terminal 236. Resistors in resistor ladder 232 may be coupled in series between terminals 234 and 234. Multiplexer 238 may have a digital input that receives user brightness setting VREG1[9:0]. The inputs to multiplexer 238 are coupled to the resistor terminals of the resistors in resistor ladder 232. In response to its digital input, multiplexer 238 will couple a selected one of its inputs to its output, which is passed to terminal 242 as voltage VREG1OUT. The value of VREG1OUT is determined by the brightness setting. When a user does not dim display 14, VREG1OUT will have its maximum value. When a user dims display 14, VREG1OUT will have a reduced magnitude.

The VREG1OUT signal is provided to digital-to-analog converter circuitry that receives digital input VREG2[7:0]. This circuitry includes resistor ladder 244. Resistor ladder 244 has a chain of resistors coupled in series between terminal 242 and terminal 246. Terminal 246 may be provided with a fixed voltage. Terminal 242 receives voltage VREG1OUT, which is determined by the user brightness setting. The inputs of multiplexer 252 are coupled to the terminals of the resistors in resistor ladder 244. The output of multiplexer 252 is passed to terminal 258 via buffer 254.

Peak luminance control circuitry 248 may be used to implement a peak luminance control algorithm. Circuitry 248 may, for example, receive frames of image data signals DATA on path 250 and may analyze the data associated with each image frame to compute image characteristics such as average luminance (e.g., the average luminance of each frame). A peak luminance control algorithm may be used to produce a desired peak luminance value (e.g., a scaling factor of the type shown in graph of FIG. 13) in response to the computed average luminance value or from other information gathered from the image data.

In response to the peak luminance control algorithm scaling factor VREG2[9:0], multiplexer 252 may supply output voltage VREGOUT2 to terminal 258 of resistor ladder 256. The scaling factor supplied to the input of multiplexer 252 directs multiplexer 252 to produce a value of VREGOUT2 that is a scaled version of the voltage VREG1OUT on terminal 242 of resistor ladder 244. The value of VREGOUT2 is therefore a function both of the user brightness setting supplied to multiplexer 238 and the peak luminance control algorithm scaling factor provided to multiplexer 252.

The value of VREGOUT2 may be used in producing the voltages on path 214. For example, VREGOUT2 may be used in producing voltage V255 (as an example). If desired, optional circuitry such as resistor ladder 256 may be used in adjusting VREGOUT2 to compensate for manufacturing variations. As shown in FIG. 17, resistor ladder 256 has a chain of resistors that are coupled between terminals 258 and 264. A fixed voltage may be provided to terminal 264. If desired, the fixed voltage provided to terminal 264 and the voltages applied to terminals 236, 234, and 246 may be adjusted using adjustable voltage supply circuits (e.g., to compensate circuitry 66 for variations in display pixel array 52 and other manufacturing variations).

Multiplexer 260 may have inputs coupled to the terminals of the resistors in resistor ladder 256. Control signals for multiplexer 260 may be supplied on multiplexer input 262. One or more output voltages may be supplied to circuitry 212 by multiplexer 260 on lines in path 280. For example, multiplexer 260 may provide circuitry 212 with a calibrated version of VREGOUT2 to serve as voltage V255. Circuitry 212 may also be provided with digital control signals on path 210 from the currently selected gamma curve look-up table 208 (FIG. 15). Based on these inputs, circuitry 212 may produce output voltages on path 214 that establish the shape of the desired gamma curve corresponding to the user brightness setting and peak luminance control scaling factor produced by the peak luminance control circuit. Images may be displayed on display pixels 54 in display pixel array 52 with the desired gamma curve using digital-to-analog converter circuitry 266. Circuitry 266 receives voltages on lines 214 that define the desired gamma curve shape, receives the image data signals DATA on path 250, and produces corresponding analog data signals D that are driven into array 52 using drivers 268 and multiplexers 270.

The foregoing is merely illustrative of the principles of this invention and various modifications can be made by those skilled in the art without departing from the scope and spirit of the invention.

What is claimed is:

1. A method of reducing burn-in effects in an array of organic light-emitting diode display pixels in a display, comprising:

receiving image data with communications circuitry in a display driver integrated circuit;

storing the image data in memory using the communications circuitry;

with control circuitry on the display driver integrated circuit, determining whether the image data is static;

with a display controller on the display driver integrated circuit, displaying the image data on the array of organic light-emitting diode display pixels while minimizing display burn-in effects in the array of organic light-emitting diode display pixels by responding to information from the control circuitry indicating that at least some of the image data is static, wherein determining whether the image data is static comprises detecting a static frame of data in the memory, and wherein storing the image data in the memory comprises issuing a write command with a decoder in the communications circuitry;

with the control circuitry, monitoring for the write command issued by the communications circuitry, wherein the control circuitry includes a countdown timer;

resetting the countdown timer in response to detection of the write command by the control circuitry; and asserting a static image data present flag with the control circuitry in response to expiration of the countdown timer.

2. The method defined in claim 1 further comprising:

storing a timeout value for the countdown timer in a register in the control circuitry that is based at least partly on temperature.

3. The method defined in claim 1 wherein displaying the image data comprises:

reducing a peak luminance value associated with a peak luminance control algorithm in response to assertion of the static image data present flag.

4. The method defined in claim 1 wherein the displaying the image data comprises:

dimming a brightness level associated with displaying the image data in response to assertion of the static image data present flag.

5. The method defined in claim 1 further comprising:

checking whether to reduce the peak luminance value by determining whether a display brightness setting for the display exceeds a predetermined display brightness threshold and determining whether a display pixel data in the image exceeds a predetermined display pixel brightness level.

6. A display, comprising:

an array of organic light-emitting diode display pixels; and display driver circuitry that is configured to display images on the array of organic light-emitting diode display pixels, wherein the display driver circuitry includes:

communications circuitry that receives image data;

memory circuitry in which the image data is stored by the communications circuitry;

control circuitry that monitors for the presence of a write command associated with storing the image data in the memory circuitry by the communications circuitry; and a display controller that takes action to reduce image burn-in effects in the array of organic light-emitting diode display pixels in response to information from the control circuitry indicating that at least some of the image data is static, wherein the control circuitry includes a countdown timer and wherein the control circuitry is configured to reset the countdown timer in response to detection of the write command, wherein the control circuitry includes a register that stores a timeout value for the countdown timer, and wherein the control circuitry is configured to assert a static image data present flag in response to a timeout condition in which the countdown timer counts from the timeout value to zero without detection of the write command.

7. The display defined in claim 6 wherein the display controller comprises peak luminance and brightness control circuitry responsive to assertion of the static image data present flag.

8. The display defined in claim 7 further comprising a temperature sensor, wherein the temperature sensor is configured measure a temperature for the array and wherein the peak luminance and brightness control circuitry makes adjustments to how the images are displayed on the display based at least partly on the measured temperature.

9. The display defined in claim 6 further comprising a temperature sensor, wherein the temperature sensor is configured to measure a temperature for the array and wherein the timeout value is based at least partly on the measured temperature.

10. The display defined in claim 6 wherein the memory is configured to store frames of data and wherein the display controller is configured to take action to reduce image burn-in effects in the array of organic light-emitting diode display pixels in response to information from the control circuitry indicating that a frame of the data is static.

* * * * *